US009566480B2

(12) United States Patent
Voges

(10) Patent No.: US 9,566,480 B2
(45) Date of Patent: Feb. 14, 2017

(54) TREATMENT FOR THE HITTING SURFACE OF A GOLF CLUB AND A METHOD FOR APPLYING THE SAME

(75) Inventor: Mitchell Voges, Simi Valley, CA (US)

(73) Assignee: MAX OUT GOLF LLC, Sherman Oaks, CA (US)

( * ) Notice: Subject to any disclaimer, the term of this patent is extended or adjusted under 35 U.S.C. 154(b) by 1142 days.

(21) Appl. No.: 11/843,417

(22) Filed: Aug. 22, 2007

(65) Prior Publication Data

US 2008/0051212 A1 Feb. 28, 2008

Related U.S. Application Data

(60) Provisional application No. 60/823,166, filed on Aug. 22, 2006.

(51) Int. Cl.
*A63B 53/04* (2015.01)
*A63B 53/00* (2015.01)

(52) U.S. Cl.
CPC ..... *A63B 53/0466* (2013.01); *A63B 53/04* (2013.01); *A63B 2053/005* (2013.01); *A63B 2053/0408* (2013.01); *A63B 2053/0445* (2013.01)

(58) Field of Classification Search
USPC ..... 473/324–350
See application file for complete search history.

(56) References Cited

U.S. PATENT DOCUMENTS 1,396,470 A * 11/1921 Taylor ..... 473/317
1,402,537 A * 1/1922 Reach ..... 473/242
1,509,429 A * 9/1924 Hillerich ..... 473/342
1,611,110 A * 12/1926 East ..... 473/342
D71,942 S * 2/1927 Hodgkins ..... D21/733
1,619,566 A * 3/1927 Crankshaw ..... 473/242
D83,700 S * 3/1931 Schmermund ..... D19/42
D84,525 S * 6/1931 Klin ..... D21/752
1,965,954 A * 7/1934 Davis ..... 473/242
2,447,967 A * 8/1948 Stone ..... 473/332
2,457,084 A * 12/1948 Kearsley et al. ..... 473/349
3,693,978 A * 9/1972 East ..... 473/314
4,413,825 A * 11/1983 Sasse ..... 473/331
4,529,203 A * 7/1985 Ribaudo ..... 473/331
D302,452 S * 7/1989 Walsh ..... D21/750
5,807,190 A * 9/1998 Krumme et al. ..... 473/342
6,129,953 A * 10/2000 Mertens ..... 427/376.6
6,193,614 B1 * 2/2001 Sasamoto et al. ..... 473/329
6,277,033 B1 * 8/2001 Krumme et al. ..... 473/342
6,381,828 B1 * 5/2002 Boyce et al. ..... 29/527.4
(Continued)

FOREIGN PATENT DOCUMENTS

JP 08000777 A * 1/1996
JP 09253250 A * 9/1997 ..... A63B 53/04
(Continued)

*Primary Examiner* — Alvin Hunter
(74) *Attorney, Agent, or Firm* — Procopio, Cory, Hargreaves & Savitch LLP; Noel C. Gillespie

(57) ABSTRACT

A treatment that can be applied to the face of a golf club head complies with USGA regulations but imparts certain advantageous characteristics. The treatment can comprise a certain pattern and can be imparted to the club head via laser etching, diamond cutting, chemical etching or any other process that will achieve the desired result. In accordance with USGA rules, the treatment must cover the intended area of impact on the golf club face.

11 Claims, 1 Drawing Sheet

(56) References Cited

U.S. PATENT DOCUMENTS

| | | | | |
|---|---|---|---|---|
| 6,402,637 | B1 * | 6/2002 | Sasamoto et al. | 473/324 |
| 6,440,011 | B1 * | 8/2002 | Hocknell et al. | 473/342 |
| D482,087 | S * | 11/2003 | Burrows | D21/733 |
| D484,936 | S * | 1/2004 | Fleck | D21/749 |
| 6,688,989 | B2 * | 2/2004 | Best | 473/332 |
| D490,487 | S * | 5/2004 | Burrows | D21/733 |
| 6,994,636 | B2 * | 2/2006 | Hocknell et al. | 473/342 |
| 7,014,568 | B2 * | 3/2006 | Pelz | 473/287 |
| 7,086,963 | B1 * | 8/2006 | Onuki et al. | 473/342 |
| 7,153,221 | B2 * | 12/2006 | Hocknell et al. | 473/342 |
| 7,166,039 | B2 * | 1/2007 | Hettinger et al. | 473/331 |
| 7,278,926 | B2 * | 10/2007 | Frame | 473/329 |
| 7,278,928 | B2 * | 10/2007 | Newman et al. | 473/342 |
| 7,448,961 | B2 * | 11/2008 | Lin | 473/332 |
| 7,465,240 | B2 * | 12/2008 | Frame | 473/329 |
| 7,576,298 | B2 * | 8/2009 | Erb et al. | 219/121.69 |
| 7,594,862 | B2 * | 9/2009 | Gilbert | 473/330 |

FOREIGN PATENT DOCUMENTS

| | | | | | |
|---|---|---|---|---|---|
| JP | 2001346920 | A | * | 12/2001 | A63B 53/04 |
| JP | 2004147694 | A | * | 5/2004 | A63B 53/04 |
| JP | 2005224383 | A | * | 8/2005 | A63B 53/04 |
| JP | 2007301016 | A | * | 11/2007 | |
| JP | 2007301017 | A | * | 11/2007 | |
| JP | 2007325859 | A | * | 12/2007 | |
| JP | 2008005994 | A | * | 1/2008 | |
| JP | 2008079969 | A | * | 4/2008 | |

* cited by examiner

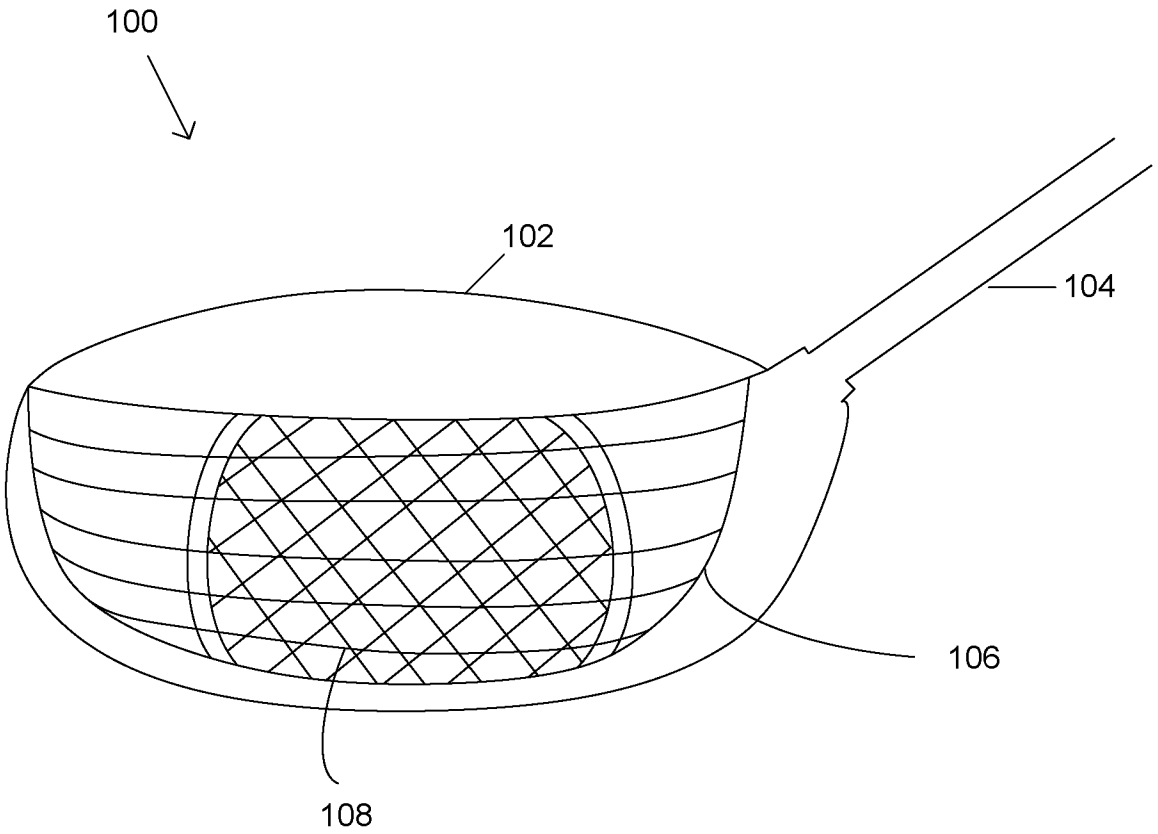
100
102
104
106
108

TREATMENT FOR THE HITTING SURFACE OF A GOLF CLUB AND A METHOD FOR APPLYING THE SAME

RELATED APPLICATION INFORMATION

This Application claims priority under 35 U.S.C. §119(e) to U.S. Provisional Patent Application Ser. No. 60/823,166, entitled "A Treatment for the Hitting Surface of a Golf Club and a Method for Applying the Same," filed Aug. 22, 2006, which is incorporated herein by reference as if set forth in full.

BACKGROUND

1. Field of the Invention

The embodiments described herein are directed to golf clubs, and more particularly to a treatment that can be applied to the golf club.

2. Background of the Invention

The United States Golf Association (USGA) is the ruling body of the game of golf in the United States and is charged with determining the legality of all golf equipment used in a USGA sanctioned events including all PGA Tour sanctioned events. In this role, the USGA has placed several limits on the performance, size, shape, and other characteristics of golf clubs. The effect of these limits has curtailed the ability of club makers to increase club performance.

For example, it is well known that recently there has been extensive innovations in driver technology designed to improve performance, e.g., improved distance and accuracy. For example, many club makers have increased the "spring-like" response imparted to the golf ball. This "spring-like" like effect produces a greater co-efficient of restitution and longer "characteristic time" measurements off the driver. This effect is produced through, or often coupled with changes in the dimensions of club head, length of driver, and changes certain other parameters.

But recent USGA limits have curtailed the cub maker's ability to make such changes. Accordingly, golf club manufacturers are currently at or very near the maximum allowable tolerances in golf club design that can produce greater performance. For example, Under Appendix II in the Rules of Golf Section 5 it states that the material and construction of, or any treatment to, the face or clubhead must not have the effect at impact of a spring, or impart significantly more or less spin to the ball than a standard steel face, or have any other effect that would unduly influence the movement of the ball. This section goes on to state that the face of the club must be hard and rigid (some exceptions may be made for putters) and, except for certain listed markings, must be smooth and must not have any degree of concavity. Further, except for marking specified in the following paragraphs, the surface roughness within the area where impact is intended ("the impact area") must not exceed that of decorative sandblasting, or of fine milling.

SUMMARY

A treatment that can be applied to the face of a golf club head complies with USGA regulations but imparts certain advantageous characteristics. The treatment can comprise a certain pattern and can be imparted to the club head via laser etching, diamond cutting, chemical etching or any other process that will achieve the desired result. In accordance with USGA rules, the treatment must cover the intended area of impact on the golf club face.

In one aspect, the treatment enhances the appearance of the club via a decorative design.

In another aspect, the treatment can act to diffuse light reflecting off the club head.

In another embodiment, the treatment can prevent the ball form momentarily sliding on the club head surface at impact.

These and other features, aspects, and embodiments of the invention are described below in the section entitled "Detailed Description."

BRIEF DESCRIPTION OF THE DRAWINGS

Features, aspects, and embodiments of the inventions are described in conjunction with the attached drawings, in which:

FIG. 1 is a diagram illustrating an example club head that includes a treatment applied in accordance with one embodiment.

DETAILED DESCRIPTION

The embodiments described herein are directed to a treatment and methods for treating the face of a golf club in accordance with the USGA rules of golf. While the embodiments described below relate to a driver, it will be understood that the treatment can be applied to any golf club. It will also be understood that any dimensions described below are by way of example only and should not be seen as limiting the embodiments unless otherwise specified.

FIG. 1 is a diagram illustrating an example golf club 100 that has been treated in accordance with one embodiment. Club 100 comprises a shaft 104 connected with a club head 102. Club head 102 includes a hitting surface 106. It is this surface 106 that makes contact with the golf ball. A treatment 108 has been applied to surface 106 as described below. It will be understood that club head 102 an surface 106 can comprise a plurality of materials including metal, composite, ceramic, plastic, or any other material suitable for the manufacture of golf clubs.

In one embodiment, the treatment can be applied using an etching technique. Any etching technique that is suitable for the material used for surface 106 can be used as long as the etching technique can achieve the results described herein. For example, the treatment can be produced by laser etching, diamond cutting, chemical etching or any other process that will achieve the desired result.

As illustrated in FIG. 1, a set of parallel grooves extend over first area or hitting surface 106. The treatment 108 should cover the intended "impact area" of the surface 106, i.e. the area designed to contact the golf ball. For example, it will be understood that a certain area of hitting surface 106 is said to comprise a "sweet spot", i.e., an area of surface 106 that produces the best results when the ball makes contact with the club in that area. Accordingly, in certain embodiments, treatment 108 is applied to a second area less than the area of hitting surface 106, the second area including the entire sweet spot or an area slightly larger than the sweet spot.

Treatment 108 can comprise a pattern that can, e.g., vary and include such patterns as diamonds, cross, swirls, lines, circles, boxes, rectangles, or any other pattern. The surface roughness produced by treatment 108 should not exceed the maximum allowable tolerance of 180 micro-inches (plus the 20 micro-inch additional cushion allowed by the USGA) and, in certain embodiments, the peak depth of the pattern created by treatment 108 should not exceed the permissible limit of 0.001 inches, or any other limit imposed by the USGA for maximum tolerances. In some embodiments, the treatment can form a groove pattern which coincides with portions of the parallel grooves in the treatment area, as illustrated in FIG. 1, and results in both parallel grooves and diamond grooves which cross over or intersect each other in area 108 in the finished club head 102. In this case, the maximum allowable depth or peak depth of the parallel grooves is 0.020 inches. In one example, the peak depth may be approximately 0.020 inches. In other embodiments, the peak depth is between approximately 0.080 and 0.010 inches.

Certain embodiments may deviate from the USGA allowed limits; however, it will be understood that such embodiments will produce a non-conforming club that is not USGA sanctioned.

Treatment 108 can produce a desirable cosmetic effect that can make club 100 more attractive to golfers. In this regard, the pattern can be varied to produce the most desirable effect. Further, treatment 108 can also help diffuse light that is reflected by surface 106, giving the club a more desirable look and feel.

Additionally, testing has shown that when a conventional golf club, such as a driver, makes contact with the golf ball, the golf ball momentarily slides on hitting surface 106. The golf ball can even start to climb the face of the club or slide laterally. This momentary slippage obviously slows the departure of the ball at impact and can adversely effect performance. Testing using treatment 108, however, has revealed that the period of slippage is reduced or eliminated, which may speed departure of the ball or limit the ball from climbing hitting surface 108. Preliminary testing has shown that for certain golfers the ball may leave the clubface with a slightly reduced amount of spin and a slightly higher ball speed from a treated driver versus an untreated driver. The overall effect may result in increased distance with the same club head speed and more accurate shots.

Further, differing degrees of surface roughness can be advantageous for different clubs throughout the set and may vary from golfer to golfer depending on their swing and ball launch characteristics.

It is important to note that any effect imparted by the treatment is within the allowable limits imposed by the USGA. In fact, numerous test samples and clubs have been submitted to the USGA for approval, which was preliminarily granted on Feb. 23, 2006.

While certain embodiments of the inventions have been described above, it will be understood that the embodiments described are by way of example only. Accordingly, the inventions should not be limited based on the described embodiments. Rather, the scope of the inventions described herein should only be limited in light of the claims that follow when taken in conjunction with the above description and accompanying drawings.

What is claimed:

1. A golf club head comprising a club face, the club face including:

a hitting surface having a sweet spot;

a treatment applied to the entire sweet spot and, optionally, an area slightly larger than the sweet spot of the hitting surface, the treatment comprising:

a pattern that reduces slippage of a golf ball on the hitting surface when the golf ball is struck using the golf club, wherein the pattern is a diamond groove pattern, a surface roughness created by the treatment, and the diamond groove pattern having a peak depth below the hitting surface, wherein the treatment is applied only to the sweet spot and, optionally the area slightly larger than the sweet spot.

2. The golf club head of claim 1, wherein the treatment is an etching.

3. The golf club head of claim 2, wherein the etching is a laser etching.

4. The golf club head of claim 2, wherein the etching is a diamond cut etching.

5. The golf club head of claim 2, wherein the etching is a chemical etching.

6. The golf club head of claim 1, wherein the peak depth is less than 180 micro-inches.

7. The golf club head of claim 1, wherein the pattern diffuses light incident on the hitting surface.

8. A golf club head comprising a club face, the club face including:

a hitting surface;

a first set of grooves extending over a first area of the club face;

a treatment applied to a second area of the hitting surface in addition to the grooves, the second area including the sweet spot of the hitting surface and being within and less than the first area of the hitting surface, the treatment being applied to the entire second area of the hitting surface and not extending beyond the second area, the treatment comprising:

a groove pattern that reduces slippage of a golf ball on the hitting surface when the golf ball is struck using the golf club, a surface roughness created by the treatment, and the groove pattern and first set of grooves intersecting one another across the entire second area, and wherein the groove pattern is one of: a diamond pattern, a swirl pattern or a circle pattern.

9. The golf club head of claim 8, wherein the treatment is an etching.

10. The golf club head of claim 8, wherein the surface roughness is less than approximately 180 micro-inches, and wherein the set of grooves have a peak depth below the hitting surface, wherein the peak depth of the set of grooves is approximately 0.020 inches.

11. The golf club head of claim 9, wherein the etching is one of the following: a laser etching, a diamond cut etching, a chemical etching.

* * * * *